US008080278B2

(12) United States Patent
Jabado et al.

(10) Patent No.: US 8,080,278 B2
(45) Date of Patent: Dec. 20, 2011

(54) COLD GAS SPRAYING METHOD

(75) Inventors: Rene Jabado, Berlin (DE); Jens Dahl Jensen, Berlin (DE); Ursus Krüger, Berlin (DE); Daniel Körtvelyessy, Berlin (DE); Volkmar Lüthen, Berlin (DE); Uwe Pyritz, Berlin (DE); Ralph Reiche, Berlin (DE); Michael Rindler, Schöneiche (DE); Raymond Ullrich, Schönwalde (DE)

(73) Assignee: Siemens Aktiengesellschaft, Munich (DE)

( * ) Notice: Subject to any disclaimer, the term of this patent is extended or adjusted under 35 U.S.C. 154(b) by 271 days.

(21) Appl. No.: 11/992,325

(22) PCT Filed: Sep. 15, 2006

(86) PCT No.: PCT/EP2006/066392

§ 371 (c)(1),
(2), (4) Date: Jun. 14, 2010

(87) PCT Pub. No.: WO2007/033936

PCT Pub. Date: Mar. 29, 2007

(65) Prior Publication Data

US 2011/0039024 A1 Feb. 17, 2011

(30) Foreign Application Priority Data

Sep. 23, 2005 (DE) ..... 10 2005 047 688

(51) Int. Cl.
*B05D 1/02* (2006.01)

(52) U.S. Cl. ..... 427/201; 427/190; 427/191; 427/193

(58) Field of Classification Search ..... 427/190, 427/191, 193, 201

See application file for complete search history.

(56) References Cited

U.S. PATENT DOCUMENTS

| | | | | |
|---|---|---|---|---|
| 6,287,714 | B1 | 9/2001 | Strock | |
| 6,344,237 | B1 | 2/2002 | Eye | |
| 6,447,848 | B1 | 9/2002 | Chow | |
| 6,465,088 | B1 * | 10/2002 | Talpaert et al. | 428/307.3 |
| 6,674,047 | B1 | 1/2004 | Hughes et al. | |
| 6,723,387 | B1 | 4/2004 | Kear et al. | |

(Continued)

FOREIGN PATENT DOCUMENTS

DE 102 24 780 A1 12/2003

(Continued)

OTHER PUBLICATIONS

Hyung-Jun Kim, Chang-Hee Lee, Soon-Young Hwang; "Fabrication of WC-Co coatings by cold spray deposition"; Surface and Coatings Technology; Article in Press; available online at www.sciencedirect.com; Others; 2004; pp. 1-6.

(Continued)

*Primary Examiner* — Frederick Parker

(57) ABSTRACT

The invention relates to a cold gas spraying method with the aid of which a substrate to be coated can be coated with particles. According to the invention, it is provided that microencapsulated agglomerates of nanoparticles are used as particles. This advantageously allows the advantages that accompany the use of nanoparticles to be used for the coating. The nanoparticles are held together by microencapsulations, wherein the microencapsulated particles formed in this way that are used in the cold gas spraying method have dimensions in the micrometer range, thereby allowing them to be used in the first place in cold gas spraying The microencapsulated nanoparticles may be used for example to produce a UV protective coating on lamp bases for gas discharge lamps.

12 Claims, 2 Drawing Sheets

U.S. PATENT DOCUMENTS

| | | | | |
|---|---|---|---|---|
| 2003/0075011 | A1 | 4/2003 | Axelbaum | |
| 2003/0219384 | A1 | 11/2003 | Baeumler | |
| 2005/0132843 | A1 * | 6/2005 | Jiang et al. | 75/252 |
| 2006/0090593 | A1 * | 5/2006 | Liu | 75/252 |

FOREIGN PATENT DOCUMENTS

| | | | |
|---|---|---|---|
| EP | 1 460 675 | A2 | 9/2004 |
| RU | 2 149 218 | C1 | 5/2000 |
| WO | WO 00/15545 | A1 | 3/2000 |
| WO | WO 2004/035496 | A2 | 4/2004 |

OTHER PUBLICATIONS

A. Kirsten, R. Moll, M. Oechsle, F. Fischer; Karbidhaltige Spritzpulver—ihre Herstellung und das Korrosionsverhalten von HVOF-Schichten; Herausgeber: P. Heinrich; Gemeinschaft Thermisches Spritzen e.V. Unterschleiβheim; 2003; pp. 19-29; DE.

S. Dallaire, B. Champagne; "Plasma Spray Synthesis of TIB2-Fe Coatings"; Thin Solid Films, No. 118; 1984; pp. 477-483; San Diego, CA.

S. Dallaire, G. Cliche; "The influence of composition and process parameters on the microstructure of TiC-Fe multiphase and multilayer coatings"; Surface and Coatings Technology, No. 50; 1992; pp. 233-239; San Diego, CA.

http://de.wikipedia.org/wiki/Kaltgasspritzen; Kaltgasspritzen aus Wikipedia, der freien Enzyklopädie; Ausdruck am; Jan. 30, 2007; 1 Page; Germany.

Capsulation; LBL-Technology(R)—A key to innovative products; May 2005; http://www.capsulation.com/; 4 Pages.

Micap Group; "Verkapselungtechnologie"; Micap plc 2005 (c) 2005; http://www.micap.de/microencapsulation.htm; Micap Group/ Microencapsulation/Sectors>Healthcare; 2 Pages.

Editors Wolfgang Beitz and Karl-Heinrich Grote; CIP-Kurztitelaufnahme der Deutschen Bibliothek: Taschenbuch für den Maschinenbau; 2001; 3 Pages (Cover and pp. N5 and N6); Book; ISBN 3-540-67777-1; 20. Aufl. Springer-Verlag Berlin Heidelberg, New York.

R.S. Lima et al.; "Microstructural characteristics of cold-sprayed nanostructured WC-Co coatings"; Sep. 2, 2002; pp. 129-135; vol. 416, No. 1-2; XPOO4389743; ISSN: 0040-6090; Elsevier Sequoia, NL.

Kim H.-J. et al.; "Superhard nano WC-12%Co coating by cold spray deposition"; Materials Science and Engineering A: Structural Materials: Properties, Microstructure & Processing, vol. 391, No. 1-2; Jan. 25, 2005; pp. 243-248, XP004698548; ISSN: 0921-5093; Lausanne, CH.

* cited by examiner

COLD GAS SPRAYING METHOD

CROSS REFERENCE TO RELATED APPLICATIONS

This application is the US National Stage of International Application No. PCT/EP2006/066392, filed Sep. 15, 2006 and claims the benefit thereof. The International Application claims the benefits of German application No. 10 2005 047 688.0 filed Sep. 23, 2005, both of the applications are incorporated by reference herein in their entirety.

FIELD OF INVENTION

The invention relates to a cold gas spraying method, wherein a cold gas jet that is directed at a substrate requiring to be coated and to which particles forming the coating are added is generated by means of a cold spray nozzle.

BACKGROUND OF THE INVENTION

The cold gas spraying method referred to above is known for example from DE 102 24 780 A1, wherein particles that are intended to form a coating on a substrate requiring to be coated are injected into a cold gas jet generated by means of a cold spray nozzle and accelerated by means of the latter preferably to supersonic speed. Consequently the particles strike the substrate with a high kinetic energy which is sufficient to ensure adhesion of the particles on the substrate or to one another. In this way coatings can be created at high deposition rates, with a thermal activation of the particles not being necessary or being necessary only to a limited extent. Thermally relatively sensitive particles can therefore be used for forming the layer. Due to the requirement to inject a kinetic energy into the particles it is necessary for these to exhibit sufficient mass inertia. The cold gas spraying is therefore limited to particle sizes in excess of 5 μm.

If it is desired to produce nanostructured layers by using nanoparticles, then according to U.S. Pat. No. 6,447,848 B1 a thermal coating method can be used. In this case the nanoparticles are suspended in a liquid and fed with said liquid to the flame jet of the thermal coating method. Mixtures of liquids can also be used in this process, thereby enabling the composition of the nanostructured layer to be influenced. The use of thermal spraying is limited to applications of this method on layer materials having a high temperature stability if the nanostructuring of the supplied nanoparticles is to remain intact (e.g. ceramic particles).

SUMMARY OF INVENTION

The object of the invention is to disclose a method for coating substrates by means of which nanostructured layers can be produced from relatively temperature-sensitive raw materials.

This object is achieved according to the invention by means of the cold gas spraying methods cited in the introduction in that microencapsulated agglomerates of nanoparticles are used as particles. In respect of the application of the cold gas spraying method, said agglomerates have sufficient mass inertia so that when they are accelerated toward the substrate that is to be coated they remain adhered on the latter. According to the invention the microencapsulation of the nanoparticles is therefore intended to enable the nanoparticles to be incorporated at all into a coating that is being formed. The advantages of the nanoparticles can be used in the coating that is in the process of being built up. In particular nanostructured coatings can be produced whose structure is determined from the nanostructure of the nanoparticles. Since the nanoparticles are made accessible to cold gas spraying by means of the method according to the invention, it is also possible to use relatively temperature-sensitive nanoparticles since this method can be performed at low temperatures compared to thermal spraying methods. However, this does not preclude a certain heating of the cold gas jet, as a result of which an additional activation of the particles can take place.

According to an advantageous embodiment of the invention it is provided that the energy input into the cold gas jet is dimensioned such that the microencapsulation of the particles onto the substrate is destroyed. By this means it can be achieved that the properties of the embodied coating are determined solely by the properties of the nanoparticles, while the decomposition products of the microencapsulation escape into the environment. This can be achieved for example due to the fact that the microencapsulation has a significantly lower boiling point in comparison with the nanoparticles, so the heat generated due to the particles striking the substrate is sufficient for evaporating the microencapsulation, without the nanoparticles becoming fused.

However, the microencapsulation can also be consciously selected such that it can be incorporated into the coating for example as a filler. In this process composites are produced from the nanoparticles and the material of the microencapsulation whose properties can be set to the specified requirements profile. For example, the microencapsulation could contain polymers, while the nanoparticles are formed from hard materials (ceramics such as $TiO_2$ for example). By this means a wear-resistant layer made of plastic can be produced owing to the hardness of the nanoparticles, said layer having exceptional ductility and adhesion owing to the properties of the plastic matrix.

If undesirable residues of the material of the destroyed microencapsulation should remain in the coating, according to a further embodiment of the invention these can be removed from the coating in a downstream method step. Heat treatment methods, for example, are suitable for this purpose, with the temperature being set in a said method such that the desired properties of the nanoparticles are not affected, but the residues of the microencapsulation escape from the coating. Another possibility is the use of chemical methods in which the residues of the microencapsulation can be released from the coating by means of, for example, a solvent. The subsequent removal of the residues of the microencapsulation can also be consciously used to produce porous nanostructured coatings.

According to another embodiment of the invention it is provided that the energy input into the cold gas jet is dimensioned such that the microencapsulation is incorporated into the coating. With this embodiment of the method the structure of the particles used for the coating is largely preserved intact, the microencapsulation forming in the coating a matrix in which the nanoparticles are contained. While the particles are striking the coating that is being formed, however, a restructuring within the particles, can take place depending on the energy input into the cold gas jet.

It is also advantageously possible for the energy input into the cold gas jet to be adjusted during the building-up of the coating. By this means it is possible to influence the structure of the coating as a function of the layer thickness, so that layers with variable properties can be produced over the layer thickness. The energy input can be changed abruptly in order to create a layer-by-layer buildup of the coating, or modified continually in order to create gradient layers.

The energy input into the cold gas jet can essentially be influenced by two energy components. Firstly, the kinetic energy input can be influenced by the degree of acceleration of the particles in the cold gas jet. This is the main influencing variable, since according to the principle of cold gas spraying it is the kinetic energy of the particles that causes the coating to be formed. A further possibility of influencing the energy input is the already mentioned possibility of feeding thermal energy to the cold gas jet in addition. This assists the heating of the particles owing to the conversion of the kinetic energy when the particles strike the coating that is being formed.

According to a special embodiment of the invention it is provided that different types of particles are added during the buildup of the coating. There is herein advantageously another possibility of endowing the coating with properties that are variable over the layer thickness. It is possible to spray particles of a specific type and, starting from a specific instant in time, to use particles of another type; it is also possible to use mixtures of particles, in which case by this means the nanostructured coating that is being formed can be overlaid by a microstructure, since a diffusion of the nanoparticles from one particle into an adjacent particle is possible only to a limited extent.

In addition it is advantageously possible for a reactive gas to be added to the cold gas jet, which gas reacts with components of the particles while the coating is being formed. A reactive gas for adding can be in particular oxygen, which when, for example, metallic nanoparticles are used leads to the forming of oxides whose wear resistance properties can be selectively used in the finished coating. Another possibility consists in the fact that the reactive gas will contribute to the dissolution of the microencapsulation material. The activation energy for the reaction with the reactive gas is advantageously produced only at the time the particles strike the coating that is being formed, when the kinetic energy of the particles is converted into thermal energy.

According to another advantageous embodiment of the invention it is provided that different types of nanoparticles are included in the particles. The mixtures of nanoparticles in the particles can react with one another when said particles strike the coating that is being formed or embody structural phases which have a mixture of the elements contained in the nanoparticles. By this means it is possible to create structural compositions with a nanostructure which it would not be possible to create by means of a standard alloy formation due to the equilibriums arising there.

It can also be achieved by suitable selection of the nanoparticles that the different types of nanoparticles react with one another during the formation of the coating. By this means it is possible to produce precursors of reaction products as nanoparticles whose reaction products would pose problems during production as nanoparticles.

It can further be provided that the nanostructure of the coating will be selectively modified in a heat treatment step downstream of the coating process. By means of the heat treatment step diffusion processes of individual alloy elements of the nanoparticles or between nanoparticles of different composition can be set in train in the structure of the nanostructured coating, it being possible to selectively influence the structural modification through temperature and duration during the heat treatment. Furthermore the heat treatment can serve to reduce possible stresses in the coating.

It is also advantageous if additives for assisting the layer formation, in particular grain growth inhibitors, are contained in the particles in addition to the nanoparticles. By means of the grain growth inhibitors it is possible for example to obtain the nanostructure during a heat treatment of the nanostructured layer while at the same time reducing stresses in the structure. Grain growth inhibitors are described for example in U.S. Pat. No. 6,287,714 B1.

A favorable application of the method advantageously consists in the substrate being formed by a plastic body, in particular a lamp base, with a protective layer being embodied as the coating to protect against electromagnetic radiation in particular in the UV range, the composition of the protective layer being modified in the area adjacent to the lamp base in the interests of good adhesion on the lamp base. The lamp base requiring to be coated can be for example lamp bases of gas discharge lamps for use in automobile headlights. If the gas discharge lamp is in operation for a relatively long period of time the components of the headlight light in the UV range are namely detrimental to the lamp base which is manufactured from plastic and decomposes under the effect of said light. The necessity to coat the lamp base in order to protect against UV radiation can be learned for example from EP 1 460 675 A2. The problem that is to be solved in the case of the coating resides in the fact that the layers suitable as UV protection have a ceramic structural composition and consequently tend, due to their brittle characteristics, to flake off from the ductile parent material of the lamp base. This can be prevented through the inventive use of the described method on account of the fact that the composition of the layer at the lamp base is optimized in the interests of good adhesion. For example, a polymer component which simultaneously forms the microencapsulation can be incorporated as well into the layer so that the latter acquires properties which are comparable in terms of ductility with those of the parent material. At a later stage in the coating method a gradient layer can then be formed in which the proportion of polymer material toward the surface of the layer decreases and finally disappears completely, since this, being a LTV-light-sensitive component, must be kept away from the radiation of the lamp. The UV-light-tight components, copper oxide for example, can be provided as nanoparticles in the microencapsulation, with the proportion of nanoparticles of this type toward the layer surface being increased up to a proportion of 100%.

Instead of a gradient layer a multi-layer structure can also be preferred, wherein the proportion of polymer material is reduced in stages. It is also possible to use elementary copper as a ductility-increasing component in the coating instead of a polymer material. This can be sprayed jointly with copper oxide as a mixture of nanoparticles. Another possibility consists in using only copper as nanoparticles, and at the same time admixing oxygen as the reactive gas into the cold gas jet, which leads to an oxidation of the nanoparticles made of copper.

BRIEF DESCRIPTION OF THE DRAWINGS

Further features of the invention are described below with reference to the drawing. Identical or corresponding drawing elements in the figures are in each case identified by the same reference signs, the latter being explained more than once only insofar as there are differences between the individual figures, in which.

DETAILED DESCRIPTION OF INVENTION

Figure 1:
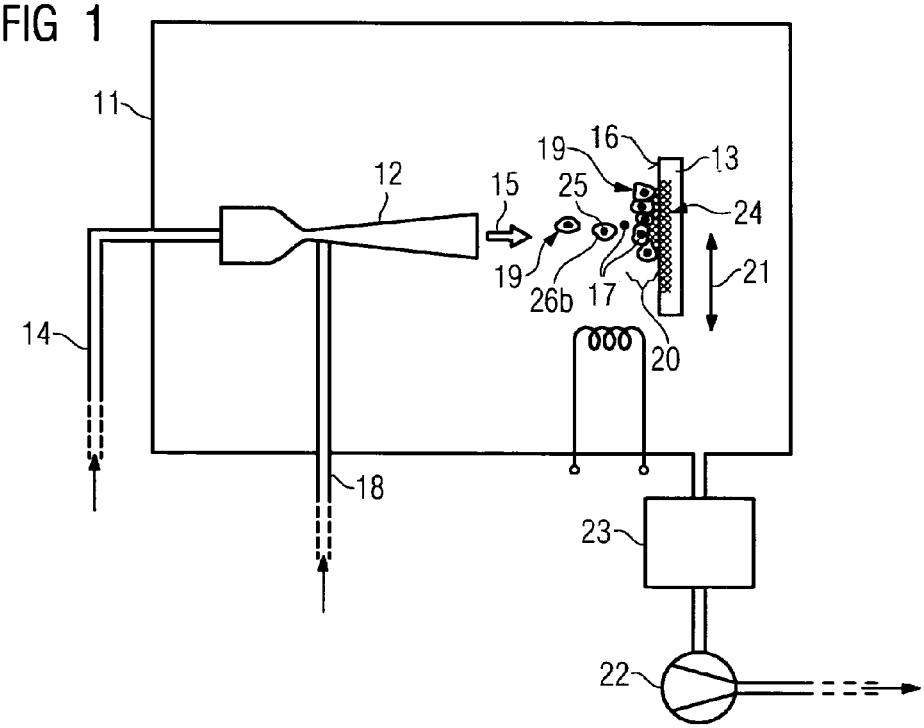
FIG. 1 schematically shows a coating tool for implementing an exemplary embodiment of the method according to the invention.

FIG. 1 shows a coating tool for cold gas spraying. This has a vacuum chamber 11 in which are disposed on the one hand a cold spray nozzle 12 and on the other hand a substrate 13 requiring to the coated (retaining fixture not shown in further detail). A process gas can be fed to the cold spray nozzle through a first line 14. As indicated by the contour, the cold spray nozzle has a Laval shape which causes the process gas to expand and be accelerated toward a surface 16 of the substrate 13 in the form of a cold gas jet (arrow 15). The process gas can contain oxygen 17, for example, as the reactive gas, which is involved in a reaction at the surface 16 of the substrate 13. The process gas can also be heated (not shown), as a result of which a required process temperature can be set in the vacuum chamber 11.

Particles 19 can be fed to the cold spray nozzle 12 through a second line 18, which particles 19 are accelerated in the gas jet and strike the surface 16. The kinetic energy of the particles 19 leads to the formation of a layer 20, into which the oxygen 17 can also be incorporated. The processes executing during the forming of the layer are explained in more detail below. In order to form the layer 20 the substrate 13 can be moved back and forth in front of the cold gas nozzle 12 in the direction indicated by the double arrow 21. During this coating process the vacuum in the vacuum chamber 11 is constantly maintained by means of a vacuum pump 22, the process gas being passed through a filter 23 before being piped through the vacuum pump 22 in order to filter out particles and other residual products of the coating which when striking the surface 16 were not bound to the latter.

Depicted by hatching in the figure is a zone of influence 24 which indicates that due to the kinetic energy of the particles 19 an interaction is produced between the areas of the substrate 13 that are close to the surface and the impacting particles 19. This leads to an adhesion of the growing layer 20 on the substrate, resulting in the substrate being microdeformed at the surface. As the layer grows further, the already adhering particles 19 enter into a comparable interaction with the newly impacting particles 19 in each case, as a result of which a continuous building up of the layer is made possible.

The particles 19 consist of an agglomerate 25 made up of nanoparticles which are held together by means of a microencapsulation 26*b*. In the exemplary embodiment of the inventive method according to FIG. 1 the microencapsulation 26*b* is preserved intact when the particles 19 strike the substrate 13. The microencapsulation thus represents a matrix in which the agglomerate of nanoparticles is bound. The nanoparticles can consist for example of copper oxide, by means of which a UV-protective coating can be applied in the case of a lamp according to FIG. 6. In this case the microencapsulation would consist of the material of the lamp base, a polymer for example, resulting in an excellent adhesion of the nanoparticles bound in the microencapsulation 26*b*. In the further course of the coating method the kinetic energy that is injected into the particles 19 by means of the cold gas nozzle 12 can be increased, with the result that the microencapsulation 26 starts to evaporate more and more as the particles strike the layer 20 that is being formed. In this way a gradient layer can be produced whose resulting surface consists solely of copper oxide in order to create an effective UV protection for the polymer of the substrate 13. The buildup of the particles 19 according to the exemplary embodiment shown in FIG. 1 is illustrated in FIG. 3.

Figure 2:
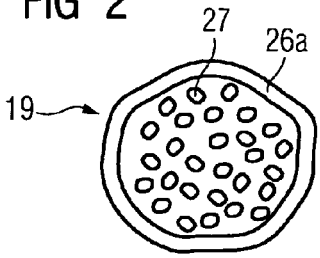
FIGS. 2 to 4 show schematic sectional views of exemplary embodiments of microencapsulated agglomerates of nanoparticles.
Figure 3:
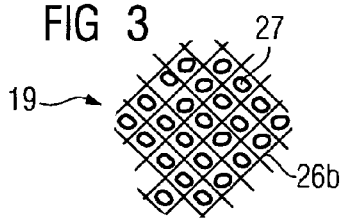
Figure 4:
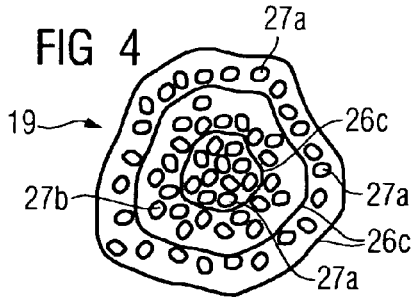

FIGS. 2 to 4 represent different variations of agglomerated nanoparticles 27 in different microencapsulations 26*a*, 26*b*, 26*c*. A microencapsulation 26*a* can be formed by introducing the nanoparticles 27 into a suspension. Within said suspension the nanoparticles agglomerate into agglomerates corresponding to the set of nanoparticles 27 shown in FIG. 2. In a further method step the suspension, in which the agglomerates of the nanoparticles 27 are already present, has added to it a material which forms the microencapsulation 26*a*. This material can be for example molecules which form what is termed a "self-assembling layer" around the respective agglomerate of nanoparticles 27. These molecules can be for example bipolar polymer molecules which automatically align themselves in the layer of the microencapsulation 26*a* and in this way produce the polymer coating with a comparatively high density. This process of self-assembling is assisted in particular by nanoparticles 27 which themselves have a charge or are embodied as a dipole.

The microencapsulation 26*b* according to FIG. 3 is produced in a suspension in a similar way to that according to FIG. 2. In this case, however, the agglomeration of the nanoparticles and the production of the microencapsulation take place simultaneously, with the result that the cross-linking for example of polymer molecules which form the microencapsulation 26*b* fixes the agglomerate that is being formed. The particles 19 according to FIG. 3 are suitable for embodiments of the method according to the invention in which the material of the microencapsulation is to be homogeneously incorporated into the layer or in which the material of the microencapsulation is intended to prevent a reaction of the nanoparticles 27 prior to the formation of the layer. In this way reactive mixtures of nanoparticles for example can be embedded in a microencapsulation.

FIG. 4 shows a particle 19 which has a multi-layer structure. The agglomerates of nanoparticles 27*a*, 27*b* are in each case provided with a microencapsulation, the microencapsulations producing a multi-layer particle. The particles 19 according to FIG. 4 can be produced in accordance with a method explained by the company Capsulution® on May 23, 2005 on its homepage www.capsulution.com under "Technology". This method is referred to there as LBL Technology® (LBL standing for "Layer By Layer"). According to said method the nanoparticles are suspended in an aqueous solution, with electrostatic forces of the material of the microencapsulation being used to form the microencapsulations around the agglomerates.

Figure 5:
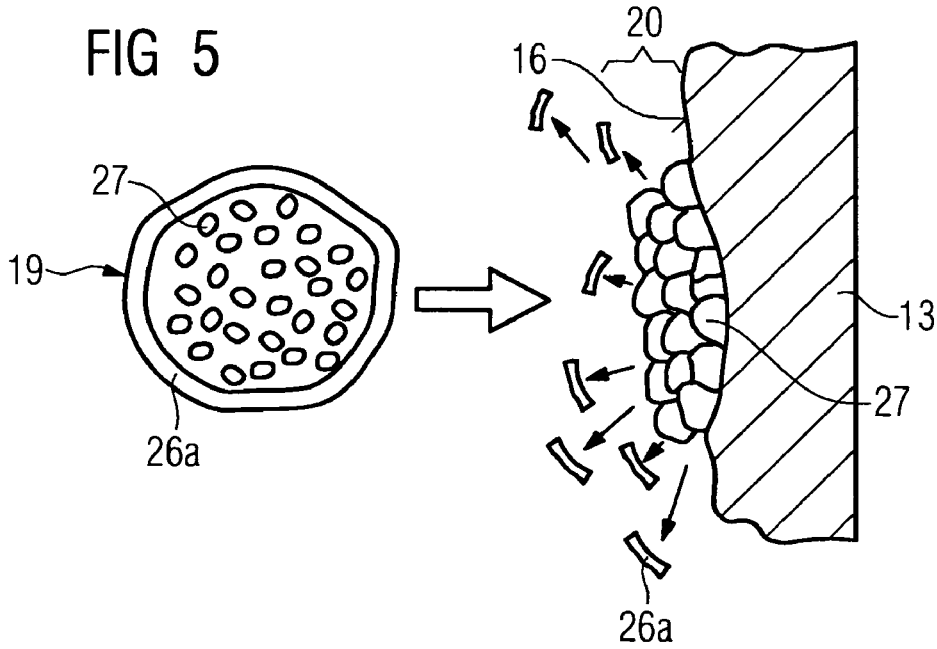
FIG. 5 shows an exemplary embodiment of the method according to the invention.

FIG. 5 is a schematic representation of an exemplary embodiment of the method according to the invention. A particle 19 is accelerated onto the surface 16 of the substrate 13, slightly deforming the latter upon impact and causing the microencapsulation 26*a* to be blasted off. In this case the nanoparticles 27 form the coating 20 which progressively thickens as the method is continued. The energy input by means of the cold spray method is adjusted such that the structural composition of the nanoparticles 27 is largely preserved intact, with the result that the nanostructure of the self-forming layer 20 is determined by the size of the nanoparticles.

Figure 6:
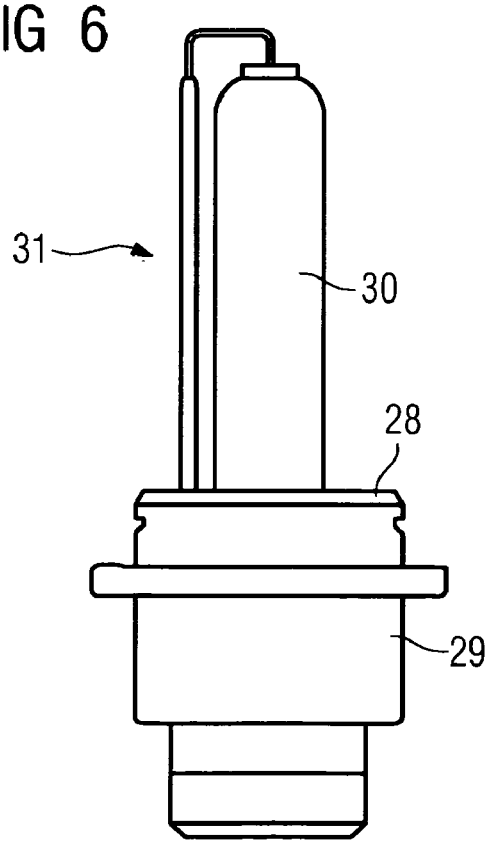
FIG. 6 shows a gas discharge lamp for automobiles which has been coated with an exemplary embodiment of the method according to the invention.

FIG. 6 shows an exemplary application for a protective layer 28 formed according to the described method as shown in FIG. 1. Said layer is applied to a lamp base 29 and thereby protects the latter from UV radiation emanating from a lamp body 30. The illustrated lamp 31 is a gas discharge lamp of the type used for automobile headlights. The lamp base 29 is provided with the protective layer 28 only in the area which is directly exposed to the UV radiation.

The invention claimed is:

1. A cold gas spraying method, comprising:

providing a substrate to be coated;

directing a cold gas jet at the substrate to be coated; and forming the coating upon the substrate by the addition of microencapsulated agglomerates of nanoparticles via the cold gas jet.

2. The method as claimed in claim 1, wherein the energy input into the cold gas jet is dimensioned such that the microencapsulation of the particles onto the substrate is destroyed.

3. The method as claimed in claim 2, wherein residues of the material of the destroyed microencapsulation are subsequently removed from the coating.

4. The method as claimed in claim 1, wherein the energy input into the cold gas jet is dimensioned such that the microencapsulation is incorporated into the coating.

5. The method as claimed in claim 4, wherein the energy input into the cold gas jet is varied during the building up of the coating.

6. The method as claimed in claim 5, wherein particles of different types are added during the building up of the coating.

7. The method as claimed in claim 6, wherein a reactive gas which reacts with components of the particles during the forming of the coating is added to the cold gas jet.

8. The method as claimed in claim 7, wherein nanoparticles of different types are contained in the particles.

9. The method as claimed in claim 8, wherein the different types of nanoparticles react with one another during the forming of the coating.

10. The method as claimed in claim 9, wherein the nanostructure of the coating is selectively modified in a heat treatment step subsequent to the coating process.

11. The method as claimed in claim 10, wherein grain growth inhibitors are contained in the particles in addition to the nanoparticles.

12. The method as claimed in claim 11, wherein the substrate is a plastic lamp base and the coating is a protective layer to protect against electromagnetic radiation in the UV range where the composition of the protective layer is modified in the area adjacent to the lamp base in the interests of good adhesion on the lamp base.

* * * * *